US012588755B2

(12) United States Patent
Li

(10) Patent No.: US 12,588,755 B2
(45) Date of Patent: Mar. 31, 2026

(54) OUTDOOR TEA TABLE

(71) Applicant: Always Outdoor Furniture Co., Ltd., Foshan (CN)

(72) Inventor: Qixiang Li, Foshan (CN)

(73) Assignee: Always Outdoor Furniture Co., Ltd., Foshan (CN)

( * ) Notice: Subject to any disclaimer, the term of this patent is extended or adjusted under 35 U.S.C. 154(b) by 58 days.

(21) Appl. No.: 18/740,486

(22) Filed: Jun. 11, 2024

(65) Prior Publication Data

US 2025/0375031 A1 Dec. 11, 2025

(51) Int. Cl.
*A47B 37/04* (2006.01)
*A47B 3/06* (2006.01)

(52) U.S. Cl.
CPC ..... *A47B 37/04* (2013.01); *A47B 3/06* (2013.01); *A47B 2220/0077* (2013.01)

(58) Field of Classification Search
CPC .. A47B 37/04; A47B 3/06; A47B 3/12; A47B 2220/0077; A47B 13/12; A47B 31/00
See application file for complete search history.

(56) References Cited

U.S. PATENT DOCUMENTS 2,428,735 A * 10/1947 Brandom ..... A47B 69/00 362/291
2,792,491 A * 5/1957 Rand ..... F21V 1/06 248/167
3,280,324 A * 10/1966 Peter ..... F21V 1/00 362/450
3,624,381 A * 11/1971 Pollack ..... F21S 6/002 D26/58
3,689,762 A * 9/1972 Shatan ..... F21V 17/007 362/311.04
5,758,960 A * 6/1998 Rocque ..... A47B 79/00 248/440
5,943,968 A * 8/1999 Dobson ..... A47B 3/12 248/167
8,297,803 B2 * 10/2012 Chen ..... F21V 17/007 362/330
8,684,552 B2 * 4/2014 de Blois ..... A47B 13/023 4/631
10,368,636 B1 * 8/2019 Hearn ..... F21V 33/0012
11,571,062 B1 * 2/2023 Huang ..... A47B 13/02
2011/0303124 A1 * 12/2011 Tseng ..... A47B 37/04 108/23
2018/0055218 A1 * 3/2018 Mueller ..... B65D 25/04
2020/0191407 A1 * 6/2020 Zemel ..... A47B 37/04

* cited by examiner

*Primary Examiner* — Daniel J Rohrhoff
(74) *Attorney, Agent, or Firm* — Justin Lampel

(57) ABSTRACT

An outdoor tea table includes: a plurality of support members, disposed along a circumferential direction of the outdoor tea table, wherein, two adjacent support members of the plurality of support members are detachably connected to each other, a connection member, detachably connected to at least two support members of the plurality of support members, where the connection member is disposed near a top end of each of the plurality of support members; a table plate, detachably connected to the connection member, where the table plate is mounted above the connection member; and a light-emitting member, detachably connected to the connection member.

5 Claims, 7 Drawing Sheets

OUTDOOR TEA TABLE

TECHNICAL FIELD

The present disclosure relates to the field of furniture, and in particular to an outdoor tea table.

BACKGROUND

As living standards of people constantly improves, people are eager to stay outdoors to relax after having busy work. In order to achieve a comfortable outdoor environment, comfortable seats, tea tables, sofas, and other outdoor furniture may be provided. With the outdoor furniture, people may enjoy the sunshine and the fresh air, relieve stresses, rejuvenate, and have work and life in an improved quality.

In the art, the tea table is large in size and may not be carried and transported easily.

SUMMARY OF THE DISCLOSURE

The present disclosure provides an outdoor tea table that can be carried and transported easily.

The present disclosure provides an outdoor tea table, including: a plurality of support members, a connection member, a table plate, and a light-emitting member. The plurality of support members are disposed along a circumferential direction of the outdoor tea table. Two adjacent support members of the plurality of support members are detachably connected to each other. The connection member is detachably connected to at least two support members of the plurality of support members. The connection member is disposed near a top end of each of the plurality of support members. The table plate is detachably connected to the connection member. The table plate is mounted above the connection member. The light-emitting member is detachably connected to the connection member.

In some embodiments, the connection part includes: a first connection portion, detachably connected to one of the plurality of support members; a second connection portion, detachably connected to another one of the plurality of support members; and a carrier portion, connected between the first connection portion and the second connection portion. The table plate and the light-emitting member are detachably connected to the carrier portion.

In some embodiments, the carrier portion includes: at least two carrying bars and two limiting bars. The at least two carrying bars are spaced apart from each other. An end of each of the at least two carrying bars is connected to the first connection portion, the other end of each of the at least two carrying bars is connected to the second connection portion. The two limiting bars are connected between two adjacent carrying bars of the at least two carrying bars. The two limiting bars are spaced apart from each other. The two limiting bars and the two carrying bars connected to the two limiting bars cooperatively define a mounting hole, a portion of the light-emitting member is mounted in the mounting hole. The table plate is mounted on the at least two carrying bars.

In some embodiments, the light-emitting member includes a power supply portion and a light-emitting portion connected to the power supply portion; the power supply portion is configured to supply power to the light-emitting portion; the power supply portion is mounted above the two limiting bars and the two carrying bars connected to the two limiting bars; the light-emitting portion is mounted through the mounting hole to be disposed below the connection member.

In some embodiments, the light-emitting portion further includes a transition portion connected between the light-emitting portion and the power supply portion, and the transition portion is mounted in the mounting hole.

In some embodiments, the power supply portion is a solar power supply portion; or the power supply portion comprises a solar power supply portion and a battery.

In some embodiments, the table plate is configured to allow light to pass through and defines a through hole, and the power supply portion is mounted in the through hole, each of the plurality of support members includes a support frame and a protection portion, the protection portion is made of PE rattan woven to an outer side of the support frame. The first connection portion is detachably connected to an inner side of the support frame of a respective one of the plurality of support members; and the second connection portion is detachably connected to an inner side of the support frame of another respective one of the plurality of support members.

In some embodiments, the connection member and top ends of a plurality of support frames cooperatively define a mounting space, the table plate is mounted in the mounting space and is surrounded by the plurality of the support members without protruding out of top ends of the plurality of support members.

In some embodiments, the outdoor tea table further includes bottom supports, each bottom support is detachably mounted on bottom ends of two adjacent support members of the plurality of support members.

In the present disclosure, the two adjacent support members are detachably connected to each other, the connection member is detachably connected to at least two support members, and the table plate and the light-emitting member are both detachably connected to the connection member. In this way, the outdoor tea table can be assembled and disassembled easily, and therefore, the outdoor tea table can be transported and carried easily.

In addition, compared to the technical solution in which the table plate and the light-emitting member are directly supported by the support members or by some housings, the table plate and the light-emitting member of the outdoor tea table of the present disclosure are supported by the connection member. Therefore, the outdoor tea table has a simple configuration and can be assembled and disassembled easily, and therefore, the outdoor tea table can be transported and carried easily.

BRIEF DESCRIPTION OF THE DRAWINGS

In order to more clearly illustrate technical solutions in embodiments of the present disclosure, accompanying drawings for describing the embodiments will be briefly described in the following. Obviously, the accompanying drawings in the following description are only some of the embodiments of the present disclosure, and other accompanying drawings may be obtained by any ordinary skilled person in the art based on these drawings without any creative work.

In order to completely understand the present disclosure and beneficial effects thereof, the present disclosure will be described by referring to the accompanying drawings, and a same reference numeral in the following description represents a same structure.

DETAILED DESCRIPTION

Figure 1:
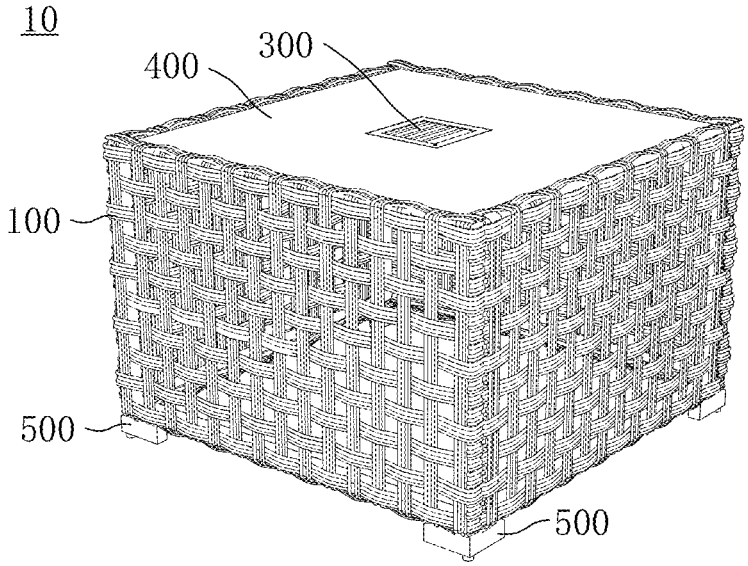
FIG. 1 is a perspective view of an outdoor tea table in a state according to one embodiment of the present disclosure.
Figure 2:
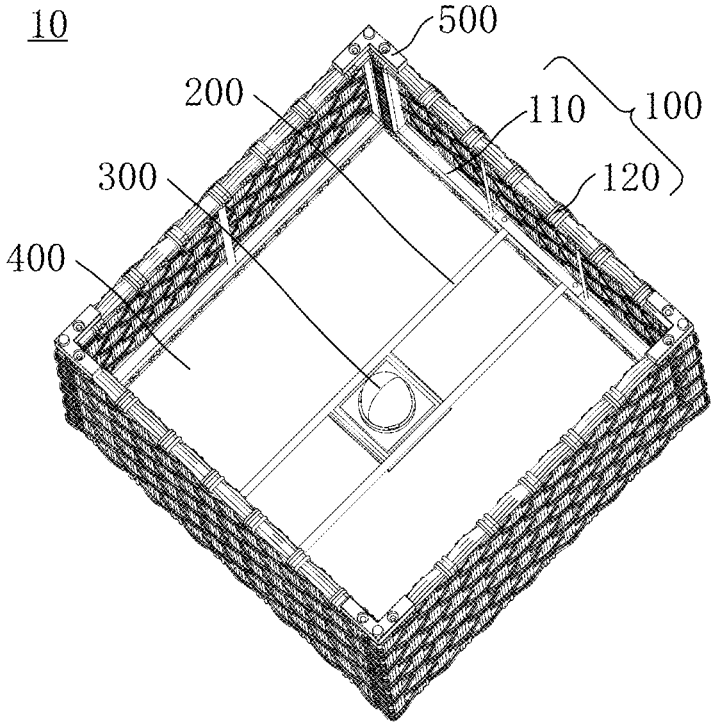
FIG. 2 is a perspective view of an outdoor tea table in another state according to one embodiment of the present disclosure.

The technical solutions in the embodiments of the present disclosure will be clearly and completely described below by referring to the accompanying drawings in the embodiments of the present disclosure. Obviously, the described embodiments are only a part of, not all of, the embodiments of the present disclosure. The following description of at least one exemplary embodiment is merely illustrative, and is not a limitation to the present disclosure or any application or use of the present disclosure. All other embodiments, which are obtained based on the embodiments in the present disclosure by any ordinary skilled person in the art without any creative work, shall fall within the scope of the present disclosure.

The term "embodiment" or "example" herein means that a particular feature, a structure, or a property described in an embodiment or an example may be included in at least one embodiment of the present disclosure. The phrase at various sections in the specification does not necessarily refer to a same embodiment, nor a separate or an alternative embodiment that is mutually exclusive of other embodiments. Any ordinary skilled person in the art shall explicitly and implicitly understand that the embodiments described herein may be combined with other embodiments.

As shown in FIGS. 1 to 14, the present disclosure provides an outdoor tea table 10 including a plurality of support members 100, a connection member 200, a table plate 400, and at least one light-emitting member 300. The plurality of support members 100 are arranged along a circumferential direction of the outdoor tea table 10, and every two adjacent support members 100 of the plurality of support members 100 are detachably connected to each other. Exemplarily, the two adjacent support members 100 are detachably connected to each other by a bottom support 500. That is, one bottom support 500 connects with the two adjacent support members 100 and is detachable from the two adjacent support members 100. Therefore, in the present disclosure, when the outdoor tea table 10 of is in use, the plurality of support members 100 are connected to each other via a plurality of bottom supports 500; and when the outdoor tea table 10 is not in use, the plurality of bottom supports 500 are detached off from the plurality of support members 100. In this way, various structures of the outdoor tea table 10 after being disassembled can be carried and transported easily. In addition, during processing and manufacturing of the plurality of support members 100, the plurality of support members 100 can be laminated on each other, a storage space for storing the plurality of support members 100 is reduced.

In some embodiments, the plurality of support members 100 have a substantially the same shape.

In some embodiments, the plurality of support members 100 have a substantially the same size.

In some embodiments, each of the plurality of support members 100 is in a shape of a flat plate.

In some embodiments, each support member 100 includes a support frame 110 and a protection portion 120. The protection portion 120 is made of PE rattan, woven to an outside of the support frame 110. That is, the protection portion 120 is disposed at the outside of the support frame 110.

Figure 4:
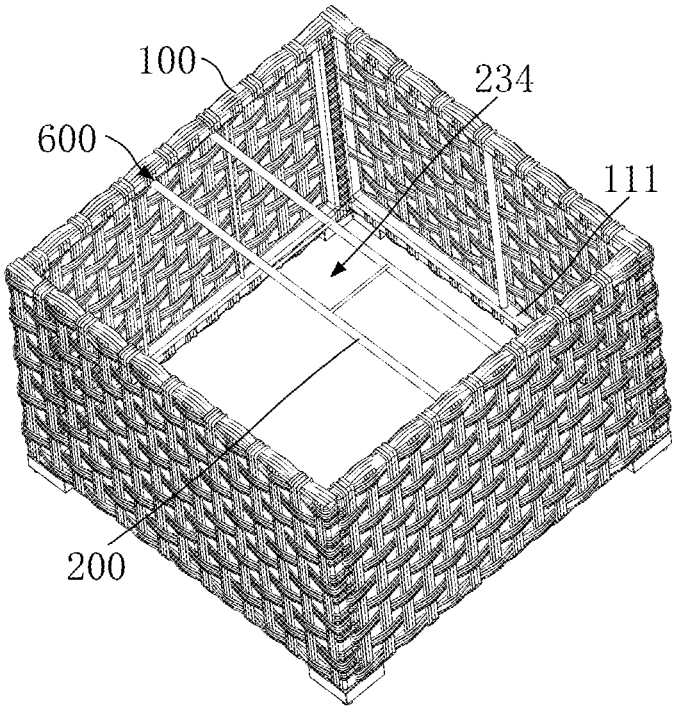
FIG. 4 is a structural schematic view of a portion of the outdoor tea table according to one embodiment of the present disclosure.
Figure 5:
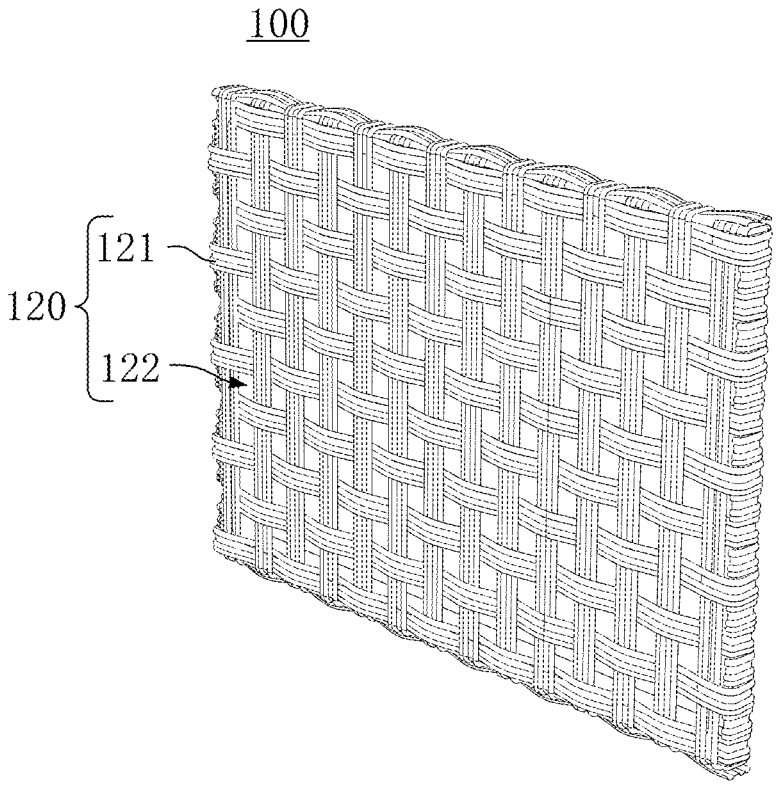
FIG. 5 is a structural schematic view of a support member of the outdoor tea table according to one embodiment of the present disclosure.
Figure 6:
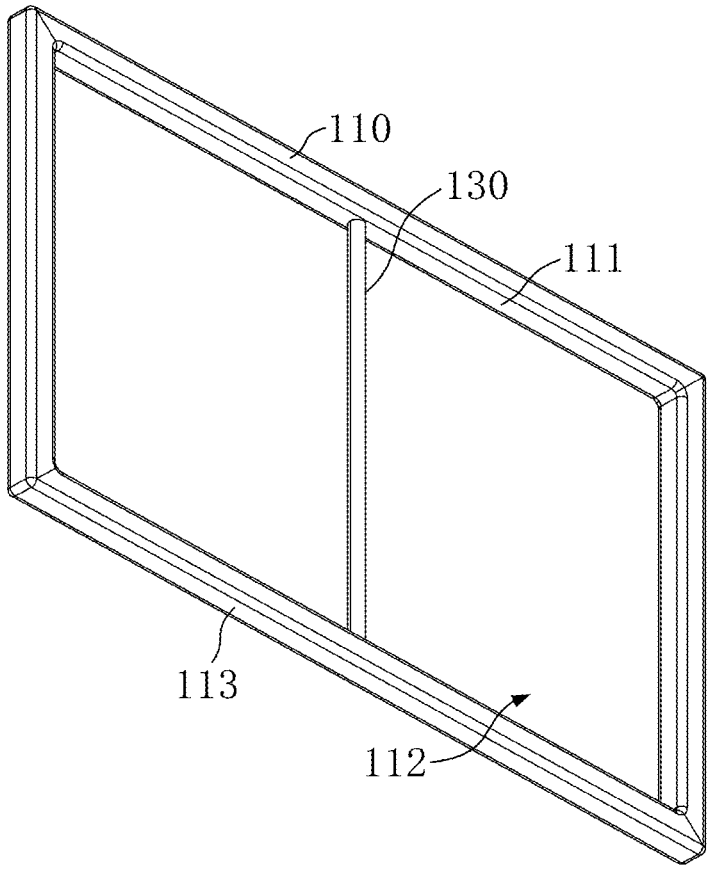
FIG. 6 is a structural schematic view of a support frame of the outdoor tea table according to one embodiment of the present disclosure.

As shown in FIGS. 4 and 6, the support frame 110 is in a frame structure. For example, the support frame 110 includes a plurality of support rods that are connected to each other from end to end. The end-to-end connected support rods cooperatively define a space 112. The support frame 110 is made of metal to ensure that the support frame 110 has certain strength. For example, the support frame 110 may be made of iron, steel, or other metal or alloy.

Exemplarily, the support frame 110 has an outer side 113 and an inner side 111. The inner side 111 is disposed at an inside of the support frame 110. The outer side 113 is disposed at an outside of the support frame 110. The protection portion 120 is disposed at an outside of the support frame 110, i.e., the protection portion 120 is disposed on the outer side 113.

Exemplarily, the support member 100 further includes a reinforcing rod 130. The reinforcing rod 130 is connected to the inner side 111 of the support frame 110 to enhance strength and stability of the support frame 110. Exemplarily, both an outer contour and an inner contour of the support frame 110 are rectangular. The reinforcing rod 130 is connected to two opposite support rods of the support frame 110.

Figure 7:
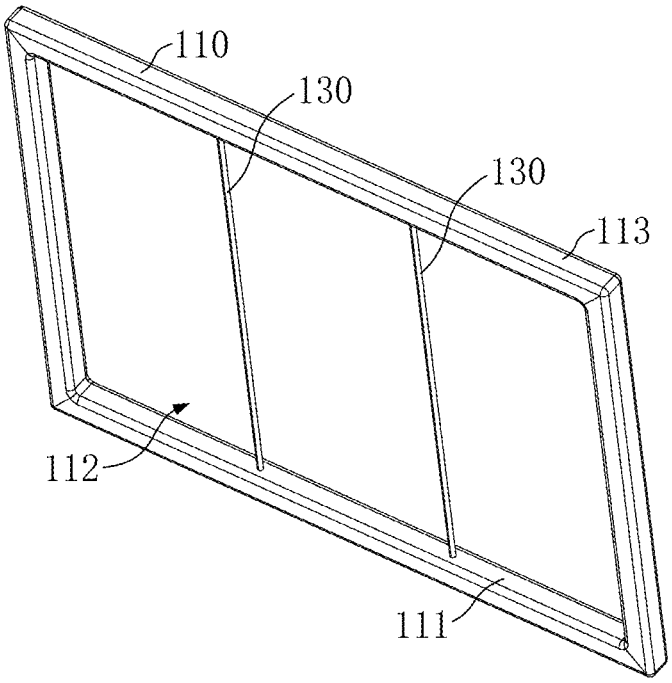
FIG. 7 is a structural schematic view of another support frame of the outdoor tea table according to one embodiment of the present disclosure.
Figure 8:
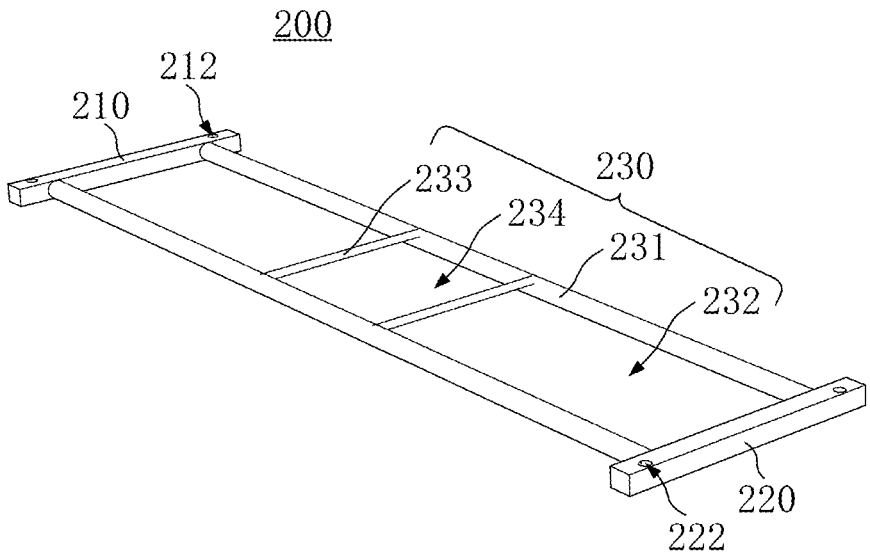
FIG. 8 is a structural schematic view of a connection member of the outdoor tea table according to one embodiment of the present disclosure.

It should be noted that FIG. 6 shows only one reinforcing rod 130 for exemplary purposes only. The present disclosure does not limit the number of reinforcing rods 130. The number of reinforcing rods 130 may be more than one. The number of reinforcing rods 130 may be determined according to the actual needs. For example, the number of reinforcing rods 130 may be two, as shown in FIG. 7.

Exemplarily, the reinforcing rod 130 and the support frame 110 may be made of the same material, such as steel, iron, or other metal or alloy.

As shown in FIGS. 1 to 5, the protection portion 120 includes a plurality of PE rattan strips 121. The plurality of PE rattan strips 121 are woven to the outer side 113 of the support frame 110. The plurality of PE rattan strips 121 are woven to the support frame 110 to define a plurality of holes 122. The plurality of holes 122 are arranged having a substantially equal interval between each other. The protection portion 120 of the present disclosure is not limited to the PE rattan strips 121, and any other structure that can be woven to the support frame 110 may be applied. It is noted that the plurality of PE rattan strips 121 are not limited to being woven to the outer side 113 of the support frame 110, but may alternatively be partially woven to the inner side 111 of the support frame 110.

As shown in FIGS. 2 to 4 and FIG. 8, the connection member 200 is detachably connected to at least two support members 100. The connection member 200 is disposed near a top end of each of the at least two support members 100. Each support member 100 has a top end and a bottom end. The bottom end of each support member 100 is configured to be placed on a support surface such as the ground. The top end and the bottom end of each support member 100 are located at two ends of the respective support member 100. Disposing the connection member 200 near the top end of the support member 100 can be interpreted as disposing the connection member 200 away from the bottom end of the support member 100.

Exemplarily, the connection member 200 is detachably connected to two of the at least two support components 100. For example, the outdoor tea table 10 of the present embodiment includes four support members 100. The connection member 200 is detachably connected to two of the four support members 100. To be noted that the number of support members 100 of the present embodiment is not limited to four, but may be other numbers, which will not be listed herein. To be noted that the connection member 200 may alternatively be detachably connected to other numbers of support members 100. For example, the connection member 200 may be detachably connected to three or four support members 100.

The two support members 100 connected to the connection member 200 are opposite to each other, or in other words, the connection member 200 connects two opposite support members 100. The connection member 200 is detachably connected to the two support members 100 by a detachable-connecting structure. The detachable-connecting structure includes, but is not limited to, screws, bolts, and clasps. For example, the connection member 200 defines one or more connection holes (212, 222). Each support member 100 connected to the connection member 200 defines one or more connection holes. Screws or bolts are screwed in the connection holes (212, 222) of the connection member 200 and in the connection holes of each support member 100 to achieve the connection between the connection member 200 and each support member 100. To be understood that the screws or the bolts can also be detached from the connection holes (212, 222) of the connection member 200 and the connection holes of the support member 100 to achieve detachment of the connection member 200 from the support member 100. In the present disclosure, the connection member 200 and the two support members 100 may be connected to each other in other detachable connection manners, which will not be illustrated herein.

Exemplarily, the connection member 200 is detachably connected to the support frame 110 of the support member 100. Exemplarily, the connection member 200 is mounted on the inner side 111 of the support frame 110. In one embodiment, the inner side 111 of the support frame 110 is not obscured by the protection portion 120, enabling the connection member 200 to be connected to the support frame 110.

In the present embodiment, two adjacent support members 100 of the plurality of support members 100 of are detachably connected to each other by one bottom support 500. The connection member 200 is detachably connected to two opposite support members 100. In this way, when the plurality of support members 100 of the outdoor tea table 10 of the present disclosure are connected to the connection member 200, strength and stability of the connected support members 100 is improved.

Exemplarily, in the present embodiment, the connection member 200 includes a first connection portion 210, a second connection portion 220, and a carrier portion 230. The first connection portion 210, the carrier portion 230, and the second connection portion 220 are connected to each other successively. In other words, the carrier portion 230 is connected between the first connection portion 210 and the second connection portion 220.

The first connection portion 210 is connected to one of the two support members 100, and the second connection portion 220 is connected to the other one of the two support members 100. That is, the first connection portion 210 is detachably connected to the inner side 111 of the support frame 110 of one support member 100, and the second connection portion 220 is detachably connected to the inner side 111 of the support frame 110 of the other support member 100.

Exemplarily, the first connection portion 210 is attached to the inner side 111 of one support frame 110, and the second connection portion 220 is attached the inner side of the other support frame 110.

The carrier portion 230 includes at least two carrying bars 231 and two limiting bars 233. One end of each of the at least two carrying bars 231 is connected to the first connection portion 210, and the other end of each of the at least two carrying bars 231 is connected to the second connection portion 220. The at least two carrying bars 231 are spaced apart from each other. The two adjacent carrying bars 231, the first connection portion 210, and the second connection portion 220 cooperatively define a space 233. The embodiment of the present disclosure is illustrated by an example of the carrier portion 230 including two carrying bars 231. It should be understood that the number of carrying bars 231 is not limited to two, and may be may be in other numbers, such as three, four, and so on.

The two limiting bars 233 are connected between the two adjacent carrying bars 231. The two limiting bars 233 are spaced apart from each other. In this way, the two limiting bars 233 and the two carrying bars 231 connected to the two limiting bars 233 cooperatively define a mounting hole 234. A light-emitting member 300 can be mounted in the mounting hole 234.

In the present embodiment, the light-emitting member 300 is detachably connected to the carrying portion 230. For example, a portion of the light-emitting member 300 is mounted in the mounting hole 234 and is limited by the two limiting bars 233 and the two carrying bars 231. In other words, the portion of the light-emitting member 300 is carried by the two limiting bars 233 and the two carrying bars 231.

Figure 10:
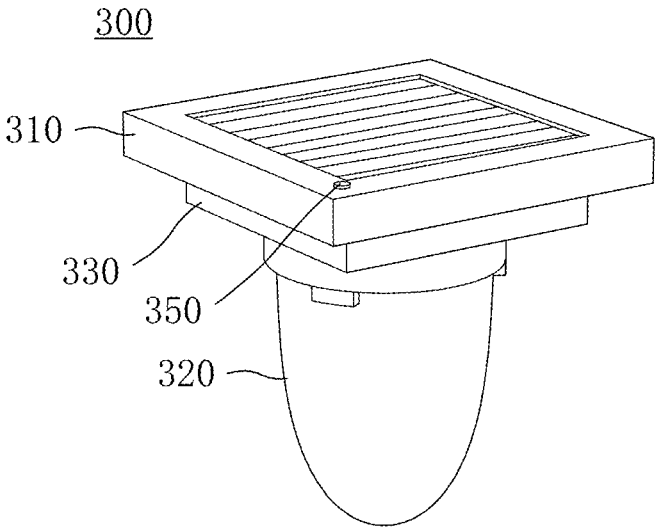
FIG. 10 is a structural schematic view of a light-emitting member of the outdoor tea table according to one embodiment of the present disclosure.
Figure 11:
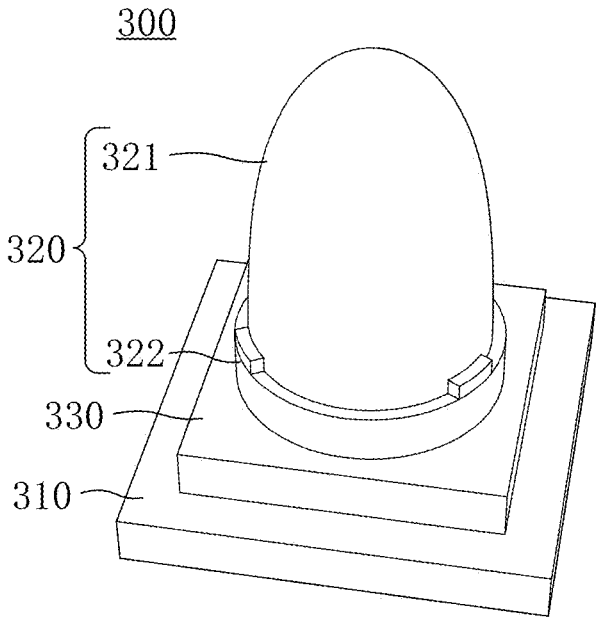
FIG. 11 is another structural schematic view of the light-emitting member of the outdoor tea table according to one embodiment of the present disclosure.

As shown in FIGS. 10 and 11, the light-emitting member 300 includes a power supply portion 310 and a light-emitting portion 320 connected to the power supply portion 310. The power supply portion 310 is configured to supply power to the light-emitting portion 320, and the light-emitting portion 320 can emit light. The power supply portion 310 is detachably mounted on the two limiting bars 233 and the two carrying bars 231 connected to the two limiting bars 233. The light-emitting portion 320 is mounted through the mounting hole 234 to be disposed below the connection member 200.

Exemplarily, the light-emitting member 300 further includes a transition portion 330 connecting between the light-emitting portion 320 and the power supply portion 310. The transition portion 330 is mounted in the mounting hole 234. It is understood that the light-emitting portion 320 of the present embodiment can pass through the mounting hole 234, the transition portion 330 is mounted in the mounting hole 234, and a size of the power supply portion 320 is greater than a size of the mounting hole 234. In this way, the power supply portion 320 is limited above the two limiting bars 233 and the two carrying bars 231. The light-emitting member 300 is mounted as follows. The light-emitting portion 320 is inserted into the mounting hole 234 from an above of the connection member 200. Subsequently, the transition portion 330 is inserted into the mounting hole 234, enabling the light-emitting portion 320 to be located below the connection member 200 and enabling the power supply portion 310 to be located above the connection member 200.

Exemplarily, a thickness of the transition portion 330 is substantially the same as a thickness of the connection member 200, and therefore, the transition portion 330 can substantially fully fill the mounting hole 234, and stability of the light-emitting member 320 being mounted in the mounting hole 234 is improved.

Figure 12:
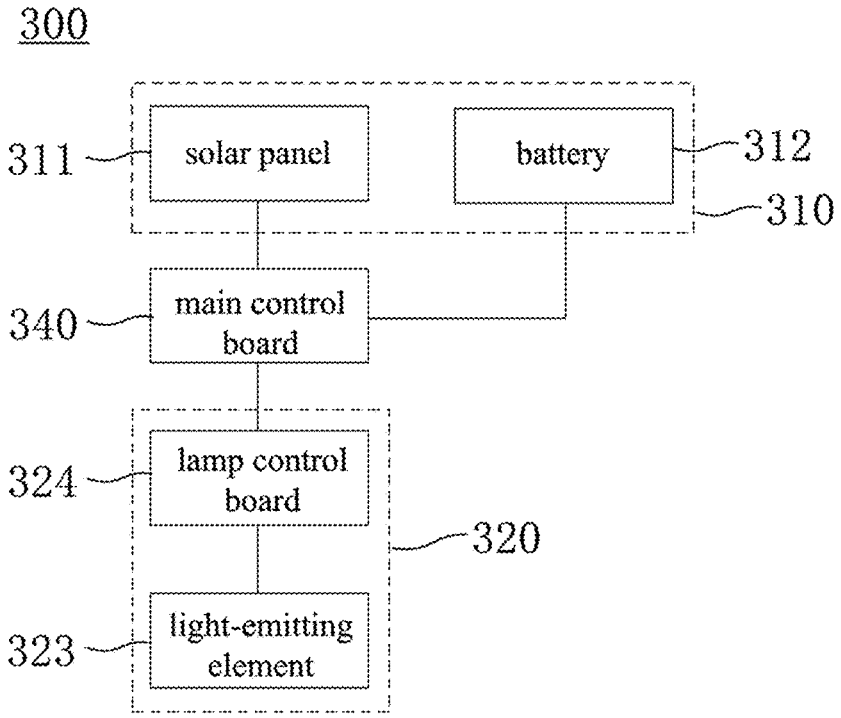
FIG. 12 is a circuit diagram of the outdoor tea table according to one embodiment of the present disclosure.

As shown in FIG. 12, the power supply portion 310 includes a solar power supply portion 311 and a battery 312. The solar power supply portion 311 may also be referred to as a solar panel 311. Exemplarily, the light-emitting member 300 further includes a main control board 340, electrically connected to the solar panel 311 and the battery 312.

In other embodiments, the power supply portion 310 is a solar power supply portion.

The light-emitting portion 320 includes a lamp control board 324 and a light-emitting element 323. The light-emitting element 323 may be a light-emitting diode (LED) element. The lamp control board 324 is electrically connected to the light-emitting element 323, for example, the light-emitting element 323 is mounted on the lamp control board 324. The lamp control board 324 is electrically connected to the main control board 340.

Exemplarily, in the present embodiment, the light-emitting member 300 further includes a control switch 350, electrically connected to the main control board 340. The main control board 340 controls, according to signals from the control switch 350, the solar panel 311 to start or stop operating. The main control board 340 controls, according to the signals from the control switch 350, the lamp control board 324 to further control the light-emitting element to emit light or stop emitting light.

Exemplarily, the solar panel 311 is mounted on a housing of the power supply portion 310, and the battery 312 is mounted inside the housing of the power supply portion 310.

Exemplarily, the main control panel 340 is mounted inside a housing of the transition portion 330.

Exemplarily, in the present embodiment, the light-emitting portion 320 further includes a lamp cover 321 and a mounting shell 322. The mounting shell 322 is connected to the transition portion 330. The lamp cover 321 is detachably mounted on the mounting shell 322. The light-emitting element 323 is covered by the lamp cover 321. It is understood that the lamp cover 321 allows light to pass through, such as being transparent.

The table plate 400 is detachably connected to the connection member 200. Further, the table plate 400 is detachably connected to the carrier portion 230. Exemplarily, the at least two carrying bars 231 carries the table plate 400. That is, the table plate 400 is detachably mounted above the at least two carrying bars 231.

Exemplarily, the at least two carrying bars 231 and the two limiting bars 233 cooperatively carries the table plate 400. That is, the table plate 400 is detachably mounted above the at least two carrying bars 231 and the two limiting bars 233.

In the present embodiment, since the light-emitting portion 320 is mounted below the connection member 200, the light-emitting portion 320 is located below the connection member 200 and the table plate 400 when the table plate 400 is mounted above the connection member 200.

In order to facilitate the light emitted by the light-emitting portion 320 to pass through the table plate 400, in the present embodiment, the table plate 400 is configured to allow light to pass through, for example, the table plate 400 is transparent.

Figure 3:
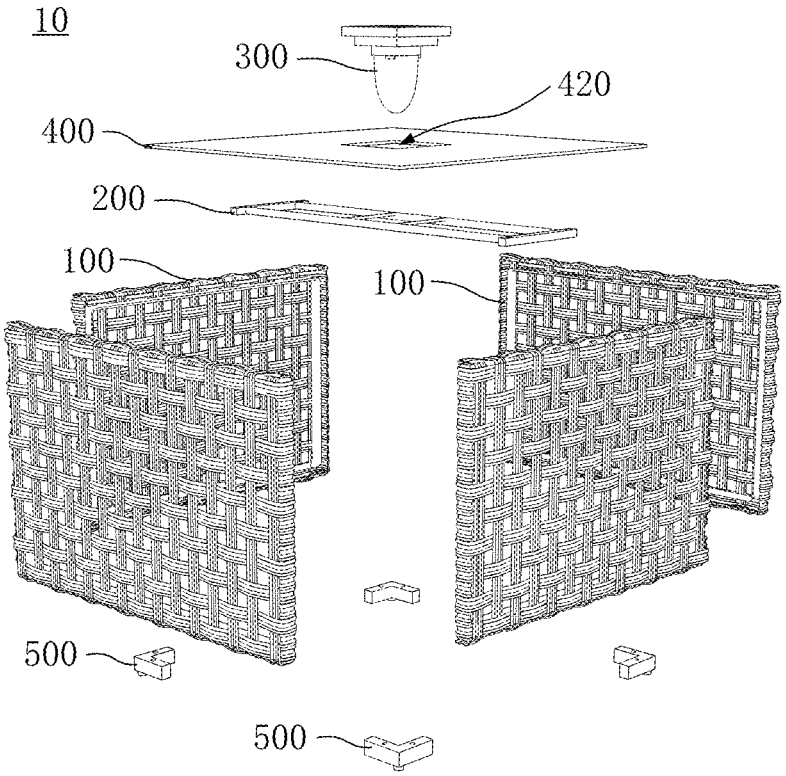
FIG. 3 is an exploded view of the outdoor tea table according to one embodiment of the present disclosure.
Figure 9:
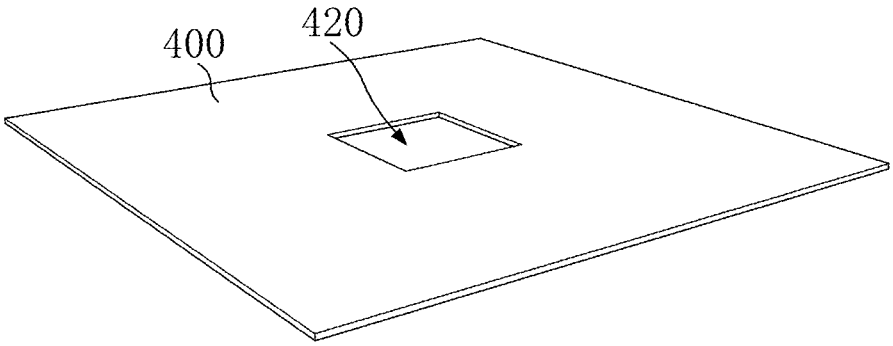
FIG. 9 is a structural schematic view of a table plate of the outdoor tea table according to one embodiment of the present disclosure.

As shown in FIGS. 3 and 9, the table plate 400 of the present embodiment defines a through hole 420. The light-emitting member 300 passes through the through hole 420. For example, the light-emitting portion 320 and the transition portion 330 pass through the through hole 420. The power supply portion 310 is mounted in the through hole 420. A size of the through hole 420 is substantially the same as a size of the power supply portion 310. A thickness of the power supply portion 310 is substantially the same as a thickness of the table plate 400. In this way, the power supply portion 310 substantially fully fills the through hole 420.

As shown in FIG. 4, in the present embodiment, in order to increase stability of the table plate 400 mounted on the at least two carrying bars 231 and the two limiting bars 233, top ends of the plurality of support frames 110 and the connection member 200 cooperatively define a mounting space 600. The table plate 400 is mounted in the mounting space 600. A circumference of the table plate 400 is limited by the plurality of support members 100. Exemplarily, the table plate is surrounded by the plurality of support members 100 and does not protrude out of the top ends of the plurality of support members 100.

Figure 13:
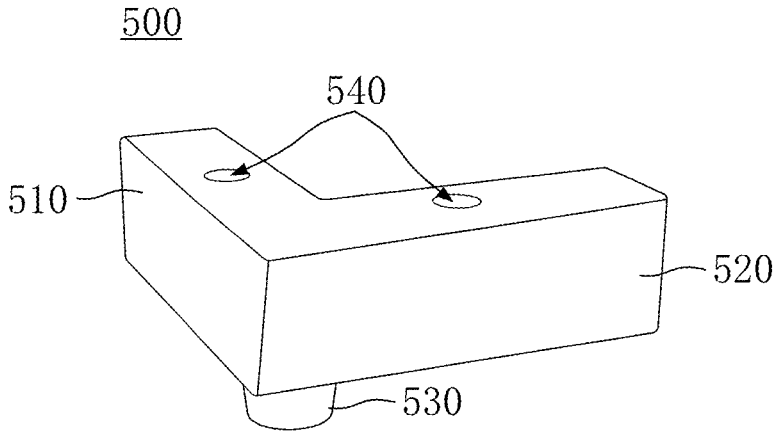
FIG. 13 is a structural schematic view of a bottom support of the outdoor tea table according to one embodiment of the present disclosure.
Figure 14:
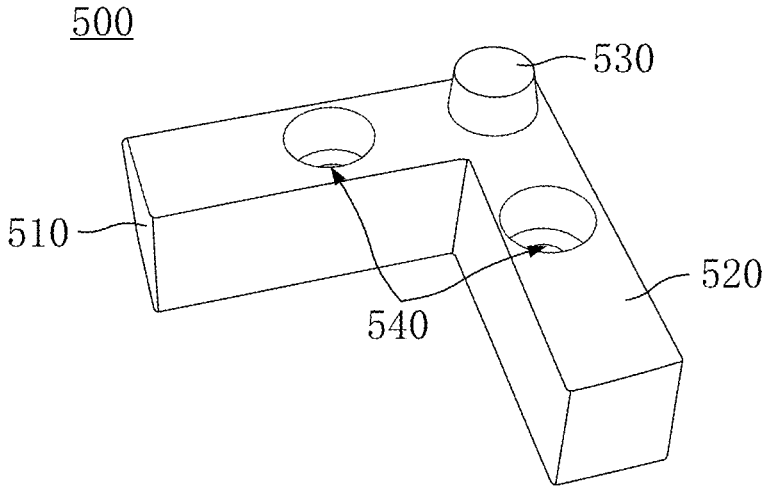
FIG. 14 is another structural schematic view of a bottom support of the outdoor tea table according to one embodiment of the present disclosure.

Exemplarily, as shown in FIGS. 13 and 14, the outdoor tea table 10 further includes a plurality of bottom supports 500. Each support foot 500 of the plurality of bottom supports 500 is detachably mounted to bottom ends of two adjacent support members 100. Exemplarily, one support foot 500 is detachably mounted to bottom ends of two adjacent support frames 110.

The detachable connection between the bottom support 500 and the support frames 110 include, but are not limited to, screws, bolts, and clasps.

For example, the bottom support 500 defines at least two fixing holes 540. Each support frame 110 defines at least one fixing hole. Screws or bolts are screwed in the at least two fixing holes 540 of the bottom support 500 and the fixing holes of the support frames 110 to achieve the connection between the two adjacent support members 100. It is understood that the screws or bolts can also be detached from the at least two fixing holes 540 of the bottom support 500 and the fixing holes of the support frames 110 to allow the two adjacent support members 100 to be detached from each other. In the present disclosure, other detachable connections between the two adjacent support members 100 may be applied, which will not be illustrated herein.

Exemplarily, the bottom support 500 includes a first support portion 510 and a second support portion 520. The first support portion 510 and the second support portion 520 are connected to each other, and the first support portion 510 and the second support portion 520 are bent with respect to each other. For example, the first support portion 510 is substantially perpendicular to the second support portion 520. At least one of the at least two fixing holes 540 of the bottom support 500 is defined in the first support portion 510, and at least one of the at least two fixing holes 540 is defined in the second support portion 520.

Exemplarily, the bottom support 500 further includes a support post 530 disposed at a connection where the first support portion 510 is connected to the second support portion 520. The support post 530 is located on a side of the bottom support 500 away from the plurality of support frames 110.

In the present embodiment, the two adjacent support members 100 are detachably connected to each other, the connection member 200 is detachably connected to at least two support members 100, and the table plate 400 and the light-emitting member 300 are both detachably connected to the connection member 200. In this way, the outdoor tea table 10 can be assembled and disassembled easily and can be transported and carried easily.

In addition, compared to a structure in which a support member or a plurality of housings are configured to support the table plate and the light-emitting member, in the present disclosure, the table plate 400 and the light-emitting member 300 of the outdoor tea table 10 are supported by one connection member 200. The outdoor tea table 10 has a simple configuration. Therefore, the outdoor tea table 10 can be assembled and disassembled easily and can be transported and carried easily.

The outdoor tea table provided by the embodiments of the present disclosure is described in detail in the above. Specific examples are described to illustrate the principles and implementations of the present disclosure. Description of the above embodiments are only used to facilitate understanding the implementation and concepts of the present disclosure. Any ordinary skilled person in the art may make changes in detailed implementation and application scopes based on the concepts of the present disclosure. In summary, the specification shall not be interpreted as a limitation of the present disclosure.

What is claimed is:

1. An outdoor tea table, comprising:

a plurality of support members, disposed along a circumferential direction of the outdoor tea table, wherein, two adjacent support members of the plurality of support members are detachably connected to each other;

a connection member, detachably connected to at least two support members of the plurality of support members, wherein, the connection member is disposed near a top end of each of the plurality of support members;

a table plate, detachably connected to the connection member, wherein, the table plate is mounted above the connection member;

a light-emitting member, detachably connected to the connection member;

a first connection portion, detachably connected to one of the plurality of support members;

a second connection portion, detachably connected to another one of the plurality of support members; and a carrier portion, connected between the first connection portion and the second connection portion;

wherein, the table plate and the light-emitting member are detachably connected to the carrier portion;

at least two carrying bars, spaced apart from each other, wherein, an end of each of the at least two carrying bars is connected to the first connection portion, the other end of each of the at least two carrying bars is connected to the second connection portion; and two limiting bars, connected between two adjacent carrying bars of the at least two carrying bars, wherein, the two limiting bars are spaced apart from each other;

wherein, the two limiting bars and the two carrying bars connected to the two limiting bars cooperatively define a mounting hole, a portion of the light-emitting member is mounted in the mounting hole; and the table plate is mounted on the at least two carrying bars.

2. The outdoor tea table according to claim 1, wherein, the light-emitting member comprises a power supply portion and a light-emitting portion connected to the power supply portion; the power supply portion is configured to supply power to the light-emitting portion; the power supply portion is mounted above the two limiting bars and the two carrying bars connected to the two limiting bars; the light-emitting portion is mounted through the mounting hole to be disposed below the connection member.

3. The outdoor tea table according to claim 2, wherein, the light-emitting portion further comprises a transition portion connected between the light-emitting portion and the power supply portion, and the transition portion is mounted in the mounting hole.

4. The outdoor tea table according to claim 2, wherein, the power supply portion is a solar power supply portion; or the power supply portion comprises a solar power supply portion and a battery.

5. The outdoor tea table according to claim 4, wherein, the table plate is configured to allow light to pass through and defines a through hole, and the power supply portion is mounted in the through hole.

* * * * *